United States Patent [19]

Okumoto

[11] Patent Number: 4,635,648

[45] Date of Patent: Jan. 13, 1987

[54] SHREDDED TOBACCO FEEDING APPARATUS FOR CIGARETTE MAKING MACHINE

[75] Inventor: Yutaka Okumoto, Musashino, Japan

[73] Assignee: Japan Tobacco, Inc., Japan

[21] Appl. No.: 687,273

[22] Filed: Dec. 28, 1984

[30] Foreign Application Priority Data

Jan. 6, 1984 [JP] Japan ..... 59-341

[51] Int. Cl.[4] ..... A24C 5/39

[52] U.S. Cl. ..... 131/109.1; 131/109.2; 131/110

[58] Field of Search ..... 131/108, 909, 109.1, 131/109.2, 110

[56] References Cited

U.S. PATENT DOCUMENTS 4,095,604 6/1978 Labbe ..... 131/109.2

*Primary Examiner*—V. Millin
*Assistant Examiner*—H. Macey
*Attorney, Agent, or Firm*—Lowe, Price, LeBlanc, Becker & Shur

[57] ABSTRACT

A shredded tobacco feeding apparatus for a cigarette making machine is disclosed. It includes a storage reservoir for temporarily storing shredded tobacco, a device for feeding a constant quantity of shredded tobacco from the reservoir continuously, a device for classifying the shredded tobacco based on a required grain length, and a device for cutting such classified shredded tobacco with a long grain length, such cut shredded tobacco being joined again with the other classified short shredded tobacco for feeding to a shredded tobacco dispersing device.

6 Claims, 8 Drawing Figures

SHREDDED TOBACCO FEEDING APPARATUS FOR CIGARETTE MAKING MACHINE

BACKGROUND OF THE INVENTION

The present invention relates to a shredded tobacco feeding apparatus within a cigarette manufacturing machine and, more particularly, to a shredded tobacco feeding apparatus for forming cigarettes which have uniform quality and high expanded-bulkiness.

It is important for a cigarette manufacturer to maintain a good quality of cigarette and to stabilize the quantity of shredded tobacco for filling in the cigarette. To eliminate the irregularity of the filling quantity of shredded tobacco renders a significant cost reducing effect of the shredded tobacco. In recent years, the price of leaf tobacco has gone up, increasing the importance of cost reduction even further. Therefore, cigarette manufacturers have made various attempts to save tobacco by, for example, reducing the irregularity of the weight of the manufactured cigarettes, increasing the expanded bulkiness by reducing the undue crushing of shredded tobacco, or otherwise by expanding the shredded tobacco by means of a special treatment in order to improve its property of expanded bulkiness.

Because of the foregoing, suppliers of cigarette manufacturing machines are also expected to supply a machine in that the irregularity of the weight of cigarette is small and the expanded bulkiness of shredded tobacco is high.

This means that the evaluation of a shredded tobacco feeding apparatus in a cigarette manufacturing machine is made based on the above mentioned two characteristics, i.e., weight and expanded bulkiness. To this end, heretofore, many proposals have been made. To reduce the irregularity of the weight of cigarette, there is proposed a density detecting method using radioisotopes with the help of marvelous development of electronic art particularly in recent years. Especially, the improvement of the controlling device has been progressed as such that a density detecting apparatus is used therein as a detecting element. One such example can be seen in Japanese Patent Application Early Publication No. 51(1976)-95198 wherein the irregularity of the weight of cigarette is markedly reduced. The concern of a cigarette manufacturer is now directed to a machine enabling to produce expanded bulky shredded cigarette and more particularly to a feeding apparatus of shredded tobacco.

On the other hand there are two factors which affect adversely efforts directed toward the improvement of the expanded bulkiness of cigarette in a cigarette manufacturing machine. One of them is; if the length of a grain of shredded tobacco is made long or in other words, if the length of the fiber shape of shredded tobacco is made as long as possible for filling, the expanded bulkiness of cigarette is improved. However, it is known that the irregularity of the weight of cigarette is increased. From the foregoing, the maker of cigarette knows that the length of the tobacco grain should preferably be in the range from about 1.5 to 4 mm. It should be noted that the term "the length of the grain" when used herein refers to substantially the desired size of a mesh of a screen for shredded tobacco.

The other factor resides in the fact that the length of the grain of shredded tobacco which is fed to a cigarette manufacturing machine becomes shorter in recent years. This is chiefly attributable to the transition of the quality of raw leaf tobacco material and to the change of treatment on the raw leaf tobacco. Consequently, it becomes impossible to maintain a sufficient expanded-bulkiness by means of the conventional picking method.

In view of these problems, many improvements have been made on a shredded tobacco feeding apparatus in a cigarette manufacturing machine. For example, a method is proposed to selectively pick up only long shredded tobacco by pin as disclosed in Japanese Patent Application Early Publication No. 52(1977)-151798. However, according to this method, short shredded tobacco is also picked up together with long shredded tobacco since the former is involved in the latter in an entangled fashion. Undue crushing of shredded tobacco is not desirable.

SUMMARY OF THE INVENTION

It is therefore a general object of the present invention to provide a shredded tobacco feeding apparatus for cigarette making machine wherein the length of tobacco grain which is to be spread and dispersed in a cigarette making machine in order to form a content of cigarette is uniformly controlled so that a cigarette with uniform quality and having high expanded bulkiness can be formed.

In order to achieve the above object and others, there is essentially provided a shredded tobacco feeding apparatus for a cigarette making machine comprising a storage reservoir for temporarily storing shredded tobacco therein, a feeding means disposed within said reservoir and adapted to continuously feed a predetermined quantity of shredded tobacco from said storage reservoir, a classifying means disposed beneath said feeding means and adapted to classify said shredded tobacco based on reguired grain length thereof, and a cutting means disposed adjacent to one end of said classifying means and adapted to cut long shredded tobacco classified by said classifying means into a proper length, said shredded tobacco after being cut being joined again with the other short shredded tobacco after being classified for feeding into a dispersing device.

DETAILED DESCRIPTION OF THE EMBODIMENTS

Nextly, preferred embodiments of the invention will be described with reference to the accompanying drawings.

Figure 1:
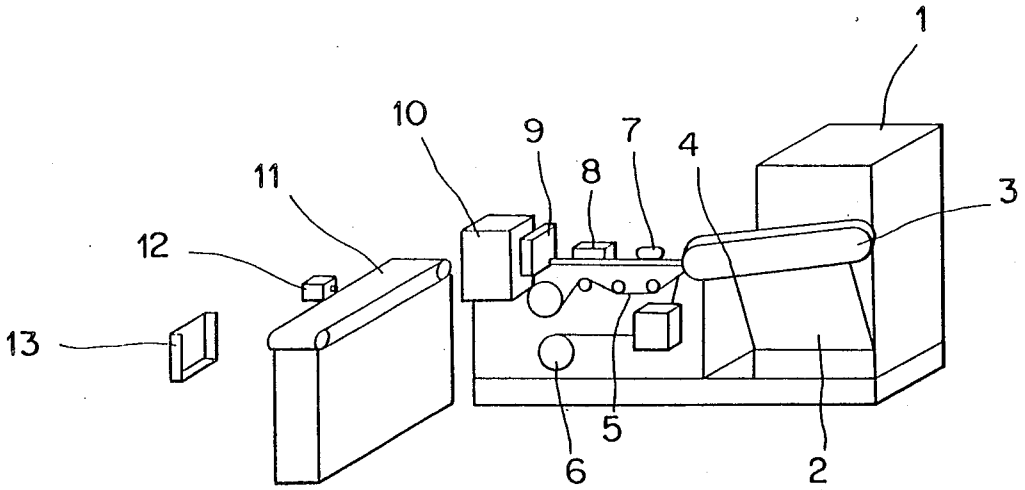
FIG. 1 is a perspective view schematically illustrating a cigarette making machine.

FIG. 1 illustrates a cigarette manufacturing machine. In the drawing, a shredded tobacco T is spread in a feeding apparatus 1 and dispersed into an air stream for transfer. Then, tobacco T is attracted and ascended within a chimney 2 and sucked by the under surface of a porous cigarette conveyor provided on the under surface of a suction chamber 3 and stacked up thereon. Such stacked shredded tobacco is carried toward the left side in the drawing and trimmed in an appropriate width by a trimmer 4 and transferred on a roll paper 6 placed on a cloth belt 5 one above the other. After being wrapped, bonded by an adhesive device 7 and dried by a heater 8, it is formed into a rod shaped cigarette. Such formed rod shaped cigarette is passed through a density detector 9. After measured by density, the rod shaped cigarette is cut into individual cigarette. Such cut cigarette is transferred on a conveyor 11. On the half way to the conveyor 11, a solenoid valve 12 is disposed so that a cigarette of inferior quality is removed and only a cigarette of acceptable quality is loaded on a tray 13.

Figure 2:
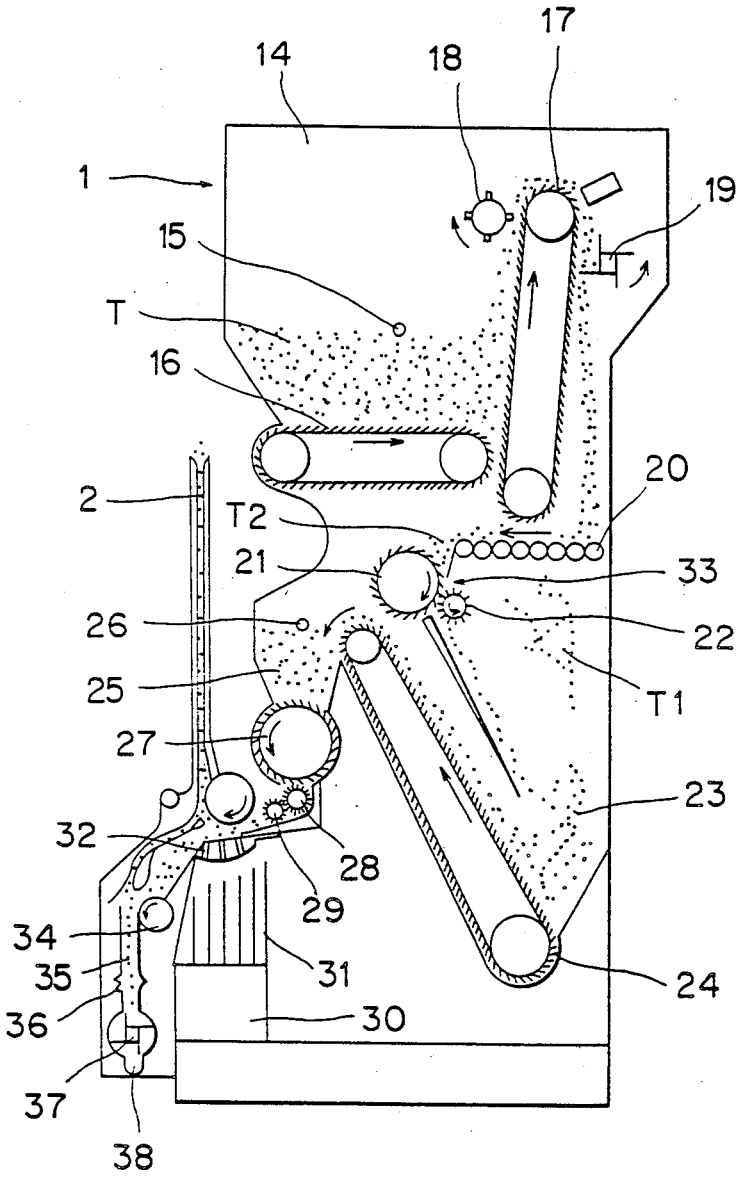
FIG. 2 is a front view in section illustrating a shred feeding apparatus according to one embodiment of the present invention.

FIG. 2 is a front view in section schematically illustrating the structure of the feeding apparatus 1 according to the present invention.

The shredded tobacco T is thrown into a storage reservoir 14 by an air stream in most cases. In quantity of tobacco in the storage reservoir 14 is determined by the height of a photoelectric tube 15. That is, when the upper surface of the shredded tobacco is lower than the position of the photoelectric tube 15, additional shredded tobacco is thrown.

An endless horizontal conveyor 16 is disposed in such a manner as to constitute a bottom of the storage reservoir 14 and to transfer shredded tobacco T in the right direction in the drawing. At the right end of the conveyor 16, an endless pin belt 17 is vertically disposed so that shredded tobacco T is scratched upward. The shredded tobacco T which is lifted upward by said pin belt 17 is removed with extra tobacco by a scratching down roller 18. As a result, the quantity of shredded tobacco T held and carried between pins planted on the pin belt 17 is maintained constant. The shredded tobacco is scratched down at the back of the pin belt 17 by a vane 19. A classifying device 20 is disposed horizontally in order to receive the shredded tobacco scratched down.

Said classifying device 20 as will be described more in detail is designed as such that the shredded tobacco thereon is rendered a motion to progress in the left direction in the drawing. At the same time, the shredded tobacco is classified according to a predetermined grain length so that shredded tobacco T1 with a short grain length will be dropped downward and shredded tobacco with a long grain length will be transferred in the left direction in the drawing.

At the left end of said classifying appartus 20, a cutting device 33 is disposed for cutting the afore-mentioned shredded tobacco T2 with a long grain length into an appropriate length. The cutting device 33 as will be described more in detail is designed as such that the shredded tobacco T2 held by a pin drum 21 is scratched out by a picker 22 positioned opposite thereto. The shredded tobacco T2 scratched out is shaken off downward. The shredded tobacco T2 is stacked up at a shreds drift 23. Said shreds drift 23 is deliberately positioned under the receiving position of the shredded tobacco T1 with a short grain length at said classifying apparatus 20. At the shreds drift 23, the shredded tobacco T2 cut in short is mixed again with a shredded tobacco T1.

A pin belt 24 formed of an endless conveyor is disposed in a declined fashion in order to carry away shredded tobacco T from said shreds drift 23. The shredded tobacco T carried upward by said pin belt 24 is thrown into a second shreds drift 25.

At the second shreds drift 25, a photoelectic tube 26 is disposed at an adequate height for detecting the stacked quantity of the shredded tobacco. That is, when the shredded tobacco is brought to be higher than the position where the photoelectric tube 26 is located, the revolving speed of the pin belt 24 is slowed down and when the shredded tobacco is brought to be lower than the position of the photoelectric tube 26, the pin belt 24 is made to revolve at fast speed so that the quantity of the shredded tobacco stacked within the second shreds drift 25 is always maintained constant.

The shredded tobacco T in said second shreds drift 25 is carried away by a pin drum 27. The pin drum 27 is a conventional pin roller formed of a cylinder with a lot of pins planted on the surface thereof. A predetermined quantity of shredded tobacco is carried away by being held between the pins. A scratching down drum 28 is disposed in order to release the shredded tobacco held by said pin drum 27. In this way, the shredded tobacco held between said pins is discharged.

According to a conventional shredded tobacco feeding apparatus of this type, it was a common practice to dispose a picker roll at the position where said scratching down drum 28 is located. That is, the shredded tobacco on said pin drum 27 was scratched downward to a following winnower 29 which is given a high speed revolving at about 1500 revolutions per minute for cutting still long shredded tobacco by means of its hitting action in order to avoid disturbance to the required motion due to the resistance of the mixture of the long shredded tobacco. Because of the foregoing arrangement, the cutting of said long shredded tobacco often resulted in undue crushing of the shredded tobacco. This means that even short shredded tobacco has been unnecessarily crushed and so disadvantageous. It is one of the marked features of the present invention to have said scratching downward drum 28 to revolve at relatively slow speed of about 500 revolutions per minute.

The shredded tobacco taken out from the pin drum 27 by said scratching downward drum 28 is accelerated by a following winnower 29 and discharged toward a passage at the left side in the drawing.

On the other hand, an air stream which is sent in under pressure through a duct 30 is changed into a uniform air stream by a current plate 31 and jetted out of a hole 32 to ascend through a chimney 2. The shredded tobacco T discharged through said winnower 29 is dispersed into said air stream and carried through the chimney 2. Then, the shredded tobacco T is sucked and affixed to the under surface of a porous band (not shown) to form a stream of filler as a content of cigarette.

In order to put it on the air stream for transfer through said chimney 2, undesirable shredded tobacco, e.g. the one of mass shape due to miscutting or stem having a large gravity for cigarette among the shredded tobacco T discharged by said winnower 29 is caused to proceed straight forward by transversing said air stream for transfer and thrown into a channel 35 by a throwing out drum 34. At the lower portion of the channel 35, an air window 36 is provided so that an air stream flowing upward is formed. The shredded tobacco having a large gravity such as a stem is separated from the other shredded tobacco, received by a vane wheel 37 and discharged out of the machine through a duct 38.

Figure 3:
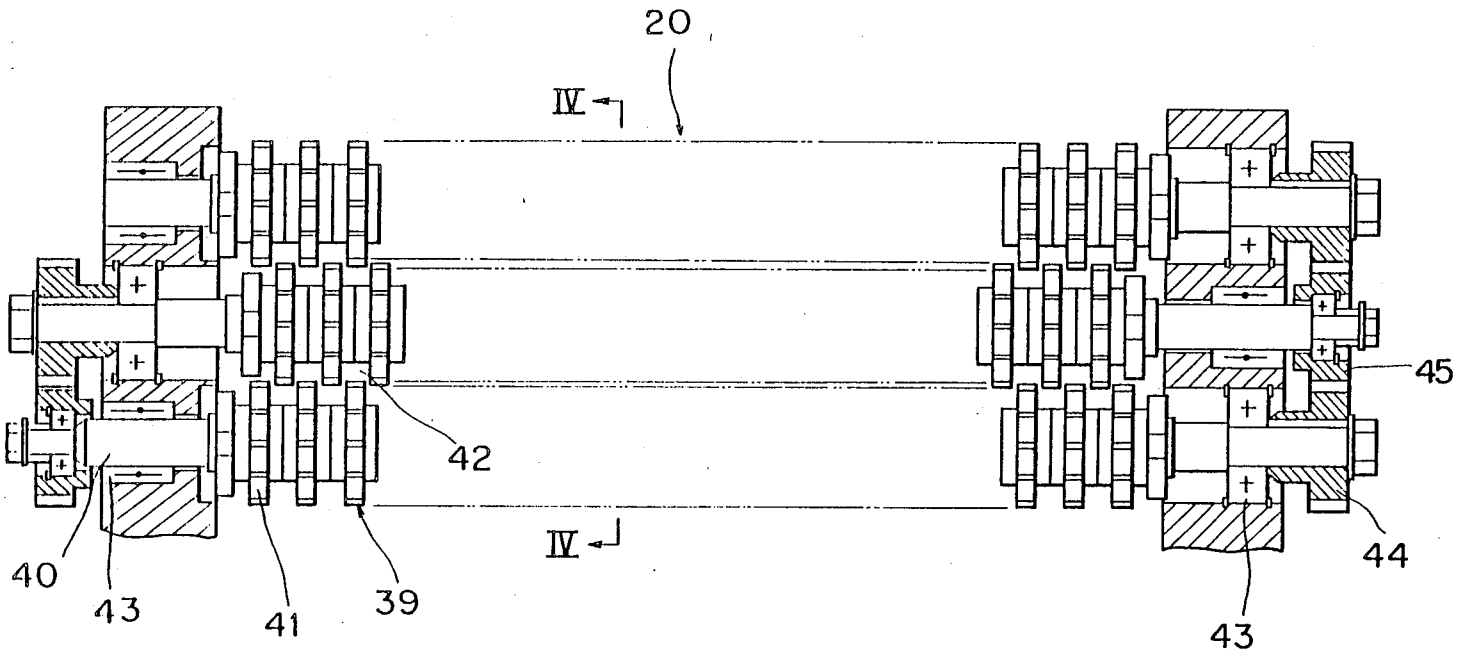
FIG. 3 is a plan view illustrating an embodiment of a classifying device.
Figure 4:
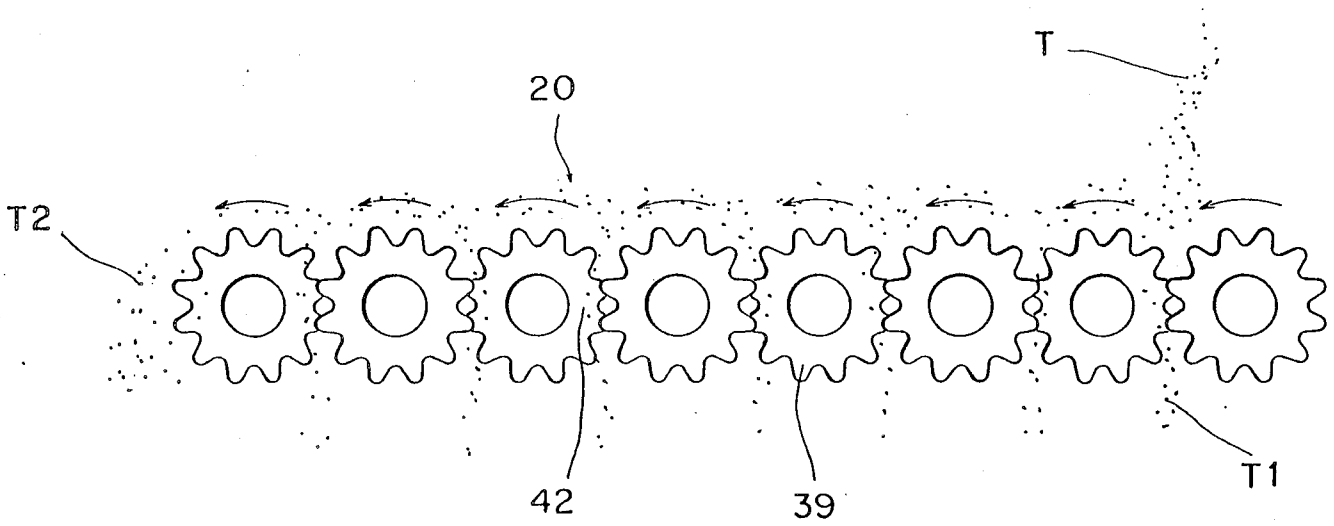
FIG. 4 is a front view of the above taken along line IV—IV of FIG. 3.
Figure 5:
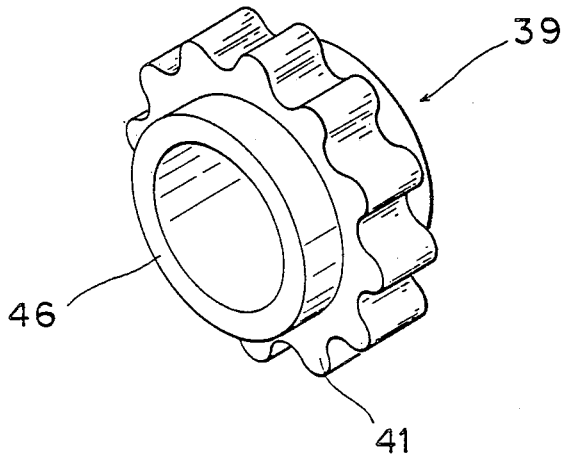
FIG. 5 is a perspective view of the outer appearance of a rotor according to an embodiment of the present invention.

FIGS. 3 through 5 illustrate embodiments of a classifying device 20.

The classifying device 20 comprises a desired number of rotors 39 and shafts 40 with said rotors 39 thrusted thereon in skewer shaped rolls, an adequate number of said rotors 39 being arranged in parallel in such a manner as to mesh the wheels 41 with respect to each other and also in a horizontal fashion with a clearance 42 defined at each of the meshing portions of said wheels 41. The both ends 43 of said shaft 40 are carried by the apparatus through bearings 43. A gear 44 is fixedly secured to one end of said shaft 40 to drive every other adjacent shaft 40 through an idler gear 45. A similar driving system is provided at the other end of said every other shaft 40. Arrangement being such that all shafts 40 are revolved in a predetermined direction. This means that all rotors 39 are revolved as such that the shredded tobacco T thereupon will be transferred in the progressing direction.

Said rotor 39 comprises, as shown in its enlarged form in FIG. 5, a hub 46 having a hole for penetrating said shaft 40 therethrough and a wheel 41 of a disk shape, said wheel 41 being formed of a deformed disk with the outer periphery formed in wave shapes and formed by injection molding of synthetic resin material or the like.

The width of said wheel 41 as well as said clearance 42 defined as an arranging distance of said shafts 40 should be adequately selected by taking into consideration the fact that they are corresponding to the size to the mesh of the screen for classification.

Figure 6:
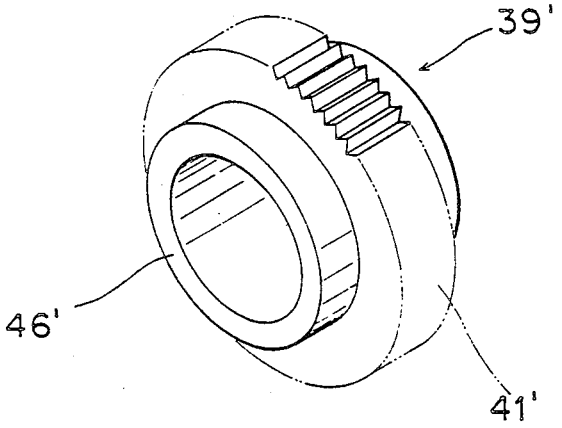
FIG. 6 is a perspective view of the outer appearance of a rotor according to another embodiment of the present invention.

FIG. 6 illustrates another embodiment of said rotor 39. This rotor 39' is constituted as a disk formed of a wheel 41' with the outer periphery formed in teeth shapes. As a still further embodiment, a rotor similar to the one shown in FIG. 6 but without forming the outer periphery in the teeth shapes may also be employed. Although this rotor is not shown, a similar classifying device to the one shown in FIG. 3 can be constituted.

Referring now to FIGS. 3 and 4, out of the shredded tobacco T dispersed into the upper stream of the classifying device 20, the shredded tobacco T1 with short grain length is dropped downward through clearances 42 formed by means of alternate arrangement of the rotors 39 with the help of the vibration effect rendered to the shredded tobacco T according to the revolution of the rotors 39 and the other shredded tobacco T2 with a long grain length is carried into the lower stream by the rotors 39.

Figure 8:
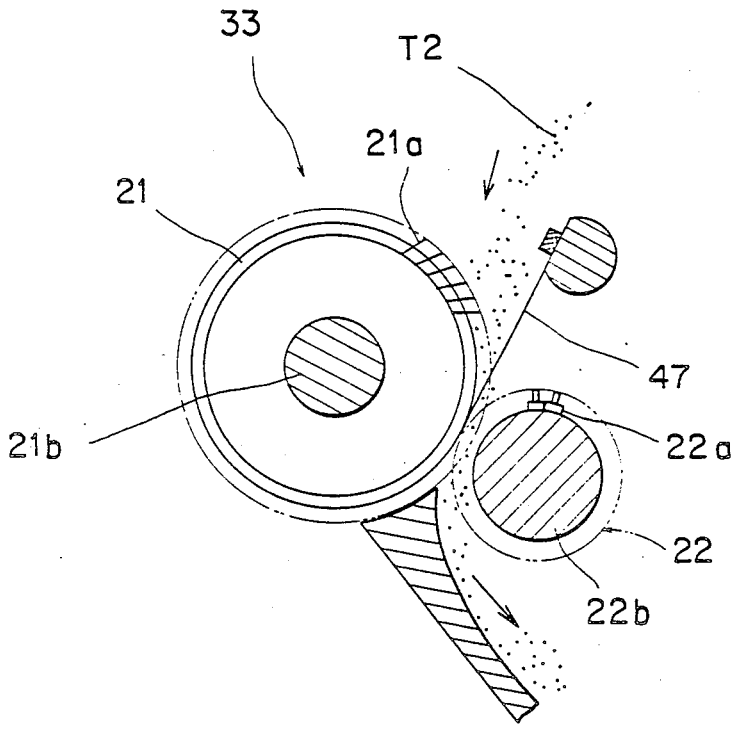
FIG. 8 is a front view of a cutting device according to the present invention.

FIG. 8 illustrates an embodiment of the cutting device 33 for the long shredded tobacco T2. This device 33 is usually used for a cigarette manufacturing machine including a pin drum 21 for effecting a clockwise revolving in the drawing through a supporting shaft **21*b*, a comb shaped metal piece 47 for holding the shredded tobacco T2 between the pins 21*a* thereof and a picker 22 for scratching downward the shredded tobacco T2 from the pin drum 21**.

The long shredded tobacco T2 transferred by the classifying device 20 is retained and caught by the pins **21*a* on the surface of the pin drum 21. In order to enhance said catching, the pins 21*a* are planted in appropriate length in forwardly declined fashion at proper angles. Each of the leg pieces of the comb shaped metal piece 47 is arranged in such a manner as to elastically press said each leg between the rows of said pins 21*a*. The picker 22 is formed of a picker roll 22*b* revolving in the counter clock direction and pins 22*a* planted on the roll surface of said picker roll 22*b*. The shredded tobacco T2 is scratched for cutting by revolving said picker 22 at a higher speed than that of the pin drum 21. The cutting length of the shreds can be changed by selecting the speed of the picker 22**.

At present, the standard of classification of the grain length to be classified by said classifying device 20 is considered to be 4 mm. That is, the shredded tobacco T1 which drops downward through the clearances 42 of said classifying device 20 is 4 mm or less. Any longer shredded tobacco T2 than that is transferred to the pin drum 21 from the classifying device 20. The shredded tobacco T2 is to be cut into 4 mm or less by the pin drum 21 and the picker 22.

Usually, there are about 23% of 4 mm or more, about 48% of from 4 to 1.5 mm and about 29% of 1.5 mm or less in the shredded tobacco T which is to be thrown into the storage reservoir 23. A preferred grain length for making cigarette is considered to be in the range from 1.5 mm to 4 mm. According to a test result obtained as an example for practising the present invention, there were 8% of 4 mm or more, 63% of from 4 to 1.5 mm and 29% of 1.5 mm or less in the shredded tobacco T stacked in the shreds drift. It shows that the cigarette suitability is improved considerably. Just for reference, in the shredded tobacco wherein all shredded tobacco is picked up according to a conventional apparatus without classifying the shredded tobacco, there was found to be 55% of from 4 to 1.5 mm. From the foregoing data, it will be understood how large the effect of the present invention is.

Figure 7:
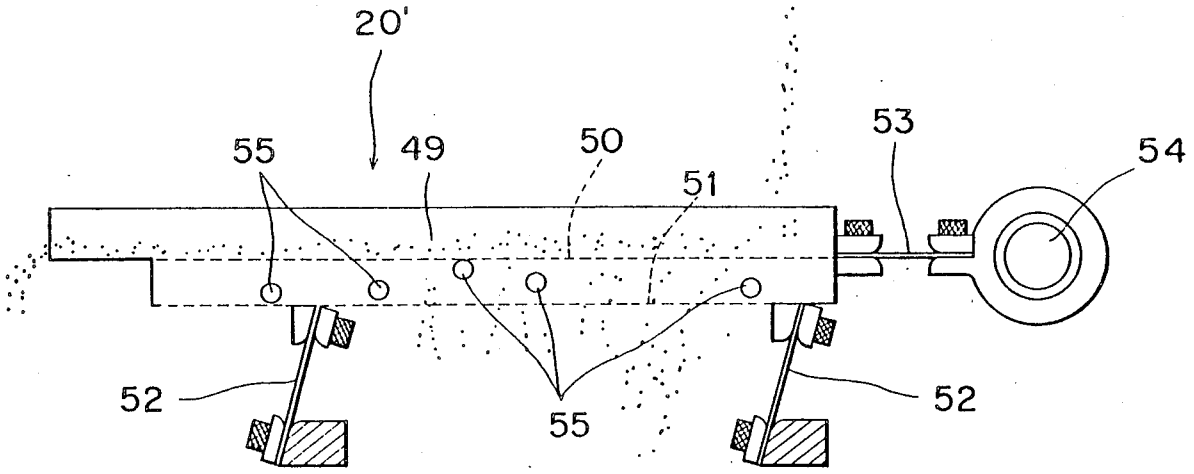
FIG. 7 is a front view of a classifying device according to another embodiment.

FIG. 7 illustrates an embodiment of another classifying device 20.

This classifying device 20 comprises a main screen body formed of screen plates 50 and 51 having a lot of pores of appropriate sizes, said plates 50 and 51 being disposed horizontally and rigidly in up and down parallel relation, said plates 50 and 51 being carried by the main apparatus through a leaf spring 52, and a leaf spring 53 extending from said main body of screen, the other end of said leaf spring 53 being engaged with an eccentric member 54 driven by a motor. Between the upper and lower screen plates 50 and 51, balls 55 are freely movably enclosed in order to prevent clogging of the mesh. The shredded tobacco T1 of 4 mm or less is dropped downward through the pores 49 by said screen plate and the long shredded tobacco T2 is transferred in the left direction in the drawing on the screen plate 50.

As described in the foregoing, according to the present invention, when shredded tobacco for forming the content of a cigarette is uniformly spread and dispersed in a shredded tobacco feeding apparatus for a cigarette manufacturing machine, the shredded tobacco is classified into a desired grain length so that irregularity against uniformity and over-crushing of the shredded tobacco can be prevented. After classification, only undesirably long shredded tobacco is cut into a desired length in order to prevent unnecessary crushing for the other. Thus obtained shredded tobacco proves to be extremely favorable in its property. The uniformity of the grain length of the shredded tobacco contributes to the uniformity of the spreading and dispersing of the shredded tobacco. In this way, a cigarette having a good filling condition of a tobacco content and a satisfactory expanded bulkiness is obtained.

What is claimed is:

1. A shredded tobacco feeding apparatus for a cigarette making machine comprising:
   - a storage reservoir for temporarily storing shredded tobacco therein;
   - a feeding means disposed within said reservoir for continuously feeding a predetermined quantity of shredded tobacco from said storage reservoir;
   - a classifying means disposed beneath for receiving shredded tobacco from said feeding means to classify said shredded tobacco based on required grain length thereof into short shredded tobacco and long shredded tobacco; and
   - a cutting means disposed adjacent one end of said classifying means for cutting long shredded tobacco classified by said classifying means into a proper length, said long shredded tobacco after being cut with said cutting means being rejoined with the other short shredded tobacco after classification for feeding into a dispersing device.

2. A shredded tobacco feeding apparatus for a cigarette making machine according to claim 1, wherein said classifying means comprises a row of rotor rollers arranged in parallel relation with each other, said rotor roller row being formed of rotor rollers of disk shapes having appropriate thickness arranged spaced apart in the axial direction, said rotor rollers being revolved in the same direction.

3. A shredded tobacco feeding apparatus for a cigarette making machine according to claim 1, wherein said classifying means comprises a vibration conveyor device including a porous plate adapted to serve as a screen, each of the pores having a suitable size.

4. A shredded tobacco feeding apparatus for a cigarette making machine according to claim 1, wherein said cutting means for cutting the long shredded tobacco comprises a pin drum having a lot of pins planted on the cylindrical surface for holding the long shredded tobaco and a picker roller disposed opposite thereto for scratching down the long shredded tobacco.

5. The apparatus of claim 4, wherein said picker roller rotates at a higher speed than the pin drum.

6. A shredded tobacco feeding appartus for a cigarette making machine comprising:
   - a storage reservoir for temporarily storing shredded tobacco therein;
   - a feeding means disposed within said reservoir for continuously feeding a predetermined quantity of shredded tobacco from said storage reservoir;
   - a classifying means disposed beneath for receiving shredded tobacco from said feeding means to classify said shredded tobacco based on required grain length thereof into short shredded tobacco and long shredded tobacco; and
   - a cutting means disposed adjacent one end of said classifying means for cutting long shredded tobacco classified by said classifying means into a proper length, said long shredded tobacco after being cut with said cutting means being rejoined with the other short shredded tobacco after classification for feeding into a dispersing device, wherein said classifying means includes a series of rollers, said series of rollers at one end thereof being disposed directly beneath said feeding means for receiving a mixture of long shredded tobacco and short shredded tobacco, said series of rollers extending in one direction towards said cutting means a sufficient distance so that the short shredded tobacco drops through the rollers into a shreds drift area and substantially only said long shredded tobacco travels the entire length of said rollers for deposit onto a pin drum of said cutting means, said pin drum coacting with a picker roller for cutting said long shredded tobacco into short shredded tobacco deposited directly into said shreds drift area for mixing with the original short shredded tobacco dropping through said rollers into said shreds drift area.

* * * * *